US008829798B2

(12) United States Patent
Takanashi

(10) Patent No.: US 8,829,798 B2
(45) Date of Patent: Sep. 9, 2014

(54) LIGHT AMOUNT CONTROL APPARATUS, CONTROL METHOD THEREFOR, AND DISPLAY APPARATUS

(75) Inventor: Ikuo Takanashi, Soka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/449,858

(22) Filed: Apr. 18, 2012

(65) Prior Publication Data

US 2012/0286674 A1 Nov. 15, 2012

(30) Foreign Application Priority Data

May 11, 2011 (JP) ..... 2011-106625

(51) Int. Cl.
*H05B 37/02* (2006.01)
*H05B 33/08* (2006.01)

(52) U.S. Cl.
CPC ..... *H05B 33/0872* (2013.01); *H05B 33/0869* (2013.01)
USPC ..... 315/158; 315/291; 315/307

(58) Field of Classification Search
USPC ..... 315/150, 152, 155, 156, 158, 291, 299, 315/307–309, 360, 129, 133–134
See application file for complete search history.

(56) References Cited

U.S. PATENT DOCUMENTS 6,153,985 A * 11/2000 Grossman ..... 315/291
6,873,262 B2 * 3/2005 Midlang ..... 340/585
7,132,335 B2 * 11/2006 Ilkbahar et al. ..... 438/286
7,391,335 B2 * 6/2008 Mubaslat et al. ..... 340/657
8,299,722 B2 * 10/2012 Melanson ..... 315/291
8,575,865 B2 * 11/2013 Chen et al. ..... 315/308
2010/0219774 A1 * 9/2010 Bianco et al. ..... 315/309

FOREIGN PATENT DOCUMENTS

JP 2005-268262 A 9/2005
JP 2006-171693 6/2006
JP 2006-171695 6/2006
JP 2010-237683 A 10/2010
WO 2009/048951 A 4/2009

OTHER PUBLICATIONS

Explanation of circumstances concerning accelerated examination concerning Japanese Patent Application No. 2011-106625.
May 30, 2014 Japanese Office Action, that issued in Japanese Patent Application No. 2011-106625.

* cited by examiner

*Primary Examiner* — James H Cho
(74) *Attorney, Agent, or Firm* — Cowan, Liebowitz & Latman, P.C.

(57) ABSTRACT

A first current amount which has been preset so that the light amount of an LED element reaches a target light amount value at a predetermined reference ambient temperature, and a thermal correction coefficient for correcting the first current amount so that the light amount of the element reaches the target light amount value at an ambient temperature different from the reference ambient temperature are stored. Furthermore, when the light amount of the LED element reaches the target light amount value, an aging correction coefficient for correcting the first current amount to correct aging at the reference ambient temperature is calculated from a second current amount supplied to the LED element and the thermal correction coefficient corresponding to the ambient temperature of the LED element, and is then stored.

18 Claims, 5 Drawing Sheets

LIGHT AMOUNT CONTROL APPARATUS, CONTROL METHOD THEREFOR, AND DISPLAY APPARATUS

BACKGROUND OF THE INVENTION

1. Field of the Invention

The present invention relates to a light amount control apparatus for controlling the light amount of an LED element, a control method therefor, and a display apparatus.

2. Description of the Related Art

In recent years, some display apparatuses such as a liquid crystal monitor use a light emitting diode (LED) as a light source to reduce the power consumption and to improve the contrast ratio. An LED element of a display apparatus has a light amount which can be changed by, for example, a pulsed current, and is activated by feedback control of the pulsed current so that light converges to a set given light amount in normal use. A display apparatus using an LED element as a light source requires a time for feedback control from when the power is turned on until light converges to a predetermined light amount.

Since an LED element has characteristics in which a voltage applied to the element changes according to a change in temperature due to heat of the element itself, the light amount changes in proportion to the temperature. That is, since a current necessary for achieving a target light amount is different depending on the ambient temperature of the LED element, a time required from when the power is turned on until light converges to a desired light amount may become long depending on the temperature if a pulsed current supplied to the element upon power-on is fixed. For example, Japanese Patent Laid-Open No. 2006-171693 discloses a technique of shortening a time required from when the power is turned on until light converges to a desired light amount by correcting, depending on the temperature, a preset pulsed current (initial pulsed current) which is supplied to an LED element upon power-on.

It is known that the light amount of an LED element decreases due to degradation of an encapsulation resin with aging. That is, since a correspondence between a current value and a light amount changes depending on aging similarly to a change in temperature, a time required from when the power is turned on until light converges to a predetermined light amount becomes long if a pulsed current which is supplied to the element upon power-on is fixed. For example, Japanese Patent Laid-Open No. 2006-171695 discloses a technique of shortening a time required until the light amount of a predetermined chromaticity is obtained, by storing the ratio of a current value when light actually converges to a desired light amount to the current value of an initial pulsed current, and multiplying the initial pulsed current by the ratio.

Japanese Patent Laid-Open Nos. 2006-171693 and 2006-171695 described above, however, disclose techniques of separately solving the influences of the ambient temperature and aging on light amount control of the LED element but do not disclose any technique of simultaneously solving the influences.

Japanese Patent Laid-Open No. 2006-171695 does not consider the influence of an ambient temperature when the current value ratio (aging correction coefficient) for correcting the influence of aging on light amount control of the LED element is stored. That is, the aging correction coefficient in Japanese Patent Laid-Open No. 2006-171695 contains the influence of the ambient temperature of the LED element when it is stored. If, therefore, an ambient temperature upon power-on is different from that when storing the aging correction coefficient, it may be impossible to obtain a pulsed current suitable for obtaining a desired light amount even though the initial pulsed current is multiplied by the aging correction coefficient.

Furthermore, if pulsed current correction using a thermal correction coefficient based on the ambient temperature (standard temperature) of the LED element when the initial pulsed current is set, like Japanese Patent Laid-Open No. 2006-171693, is additionally executed, it may be impossible to obtain an appropriate pulsed current. In some cases, the obtained pulsed current may be farther from an appropriate value.

Consider a case in which the ambient temperature when storing the aging correction coefficient is higher than the standard temperature according to Japanese Patent Laid-Open No. 2006-171695. In this case, since the obtained aging correction coefficient contains the influence of the ambient temperature, it may be larger than an aging correction coefficient calculated for the standard temperature. Assume that the ambient temperature upon power-on is the standard temperature. In this case, if the initial pulsed current is multiplied by the aging correction coefficient, an obtained pulsed current value may be unwantedly high. Since, however, the thermal correction coefficient in Japanese Patent Laid-Open No. 2006-171693 is 1 at the standard temperature, it may be impossible to correct the pulsed current to an appropriate value even though the pulsed current is multiplied by the thermal correction coefficient. Alternatively, if the ambient temperature upon power-on is the same as that when storing the aging correction coefficient (higher than the standard temperature), it is possible to obtain an appropriate pulsed current at this time by multiplying a default pulsed current by the aging correction coefficient. Since, however, correction according to Japanese Patent Laid-Open No. 2006-171693 is subsequently executed, a finally obtained pulsed current value may be larger than an appropriate value (because the thermal correction coefficient is larger than 1 when the ambient temperature is higher than the standard temperature).

SUMMARY OF THE INVENTION

The present invention has been made in consideration of the problems of the conventional techniques. The present invention provides a technique of obtaining a coefficient for correcting the influence of aging on the light amount of an LED element in consideration of the influence of the ambient temperature of the LED element.

According to one aspect of the present invention, there is provided a light amount control apparatus for controlling a light amount of an LED element by current control, comprising: an drive control unit configured to supply a current to the LED element; a light amount detection unit configured to detect the light amount of the LED element; a temperature detection unit configured to detect an ambient temperature of the LED element; a storage unit configured to store a first current amount which has been preset so that the light amount of the LED element reaches a target light amount value at a predetermined reference ambient temperature, and a thermal correction coefficient for correcting the first current amount so that the light amount of the LED element reaches the target light amount value at an ambient temperature different from the reference ambient temperature; and a calculation unit configured to calculate, when the light amount of the LED element detected by the light amount detection unit reaches the target light amount value, from a second current amount supplied to the LED element by the drive control unit and the thermal correction coefficient corresponding to the ambient temperature of the LED element, an aging correction coefficient for correcting the first current amount to correct a change in light amount due to aging of the LED element at the reference ambient temperature, and to store the calculated aging correction coefficient in the storage unit.

Further features of the present invention will become apparent from the following description of exemplary embodiments (with reference to the attached drawings).

DESCRIPTION OF THE EMBODIMENTS

A preferred embodiment of the present invention will be described in detail below with reference to the accompanying drawings. Note that in the embodiment to be explained below, a case in which the present invention is applied to a liquid crystal monitor, as an example of a light source control apparatus, which can control a current to be supplied to an LED element will be described. The present invention, however, is applicable to an arbitrary device which can control a current to be supplied to an LED element.

(Structure of Liquid Crystal Monitor 100)

Figure 1:
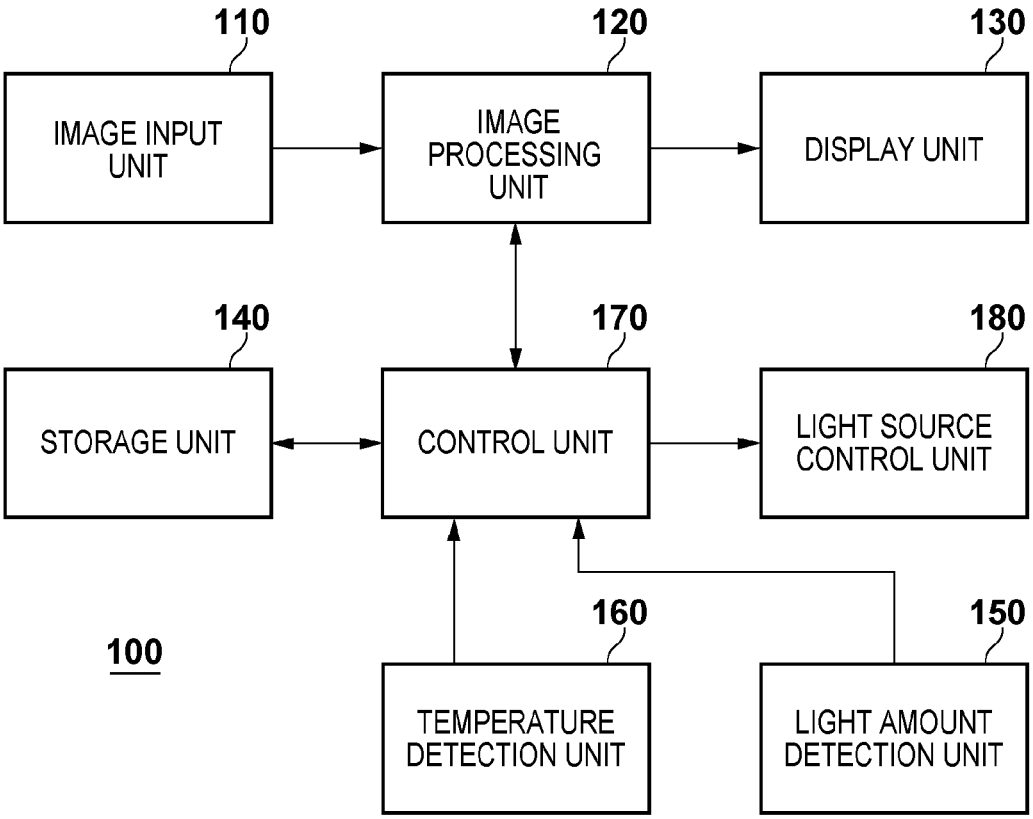
FIG. 1 is a block diagram showing the functional arrangement of a liquid crystal monitor according to an embodiment of the present invention.

FIG. 1 is a block diagram showing the functional arrangement of the liquid crystal monitor 100 according to the embodiment of the present invention.

A control unit 170 is, for example, a microprocessor, which controls the operation of each block of the liquid crystal monitor 100. More specifically, the control unit 170 controls the operation of each block of the liquid crystal monitor 100 by reading out a program for light amount control processing (to be described later) stored in a storage unit 140, mapping the program on a RAM (not shown), and then executing the program.

The storage unit 140 is, for example, a rewritable nonvolatile memory such as an EEPROM, which stores parameters and the like necessary for the operation of each block as well as the program for the light amount control processing. In the embodiment, the storage unit 140 is assumed to store the initial duty ratio of a pulsed current to be supplied upon power-on and a target light amount value as a light amount value for converging light from each color LED element, which have been set for each LED element of a light source control unit 180 before shipping from a factory.

Note that the initial duty ratio indicates the ratio between the frequency and pulse width of a pulsed current which have been preset for each color LED element so that an LED light source emits, at a predetermined reference ambient temperature, light having a predetermined luminance and chromaticity which have been set as a target light amount value for the LED light source before shipping from a factory. If the frequency of the pulsed current to be supplied to each color LED element is fixed, it is possible to define, based on the pulse width, a pulsed current to be supplied upon power-on by the duty ratio. If the liquid crystal monitor 100 is designed so that the user can adjust the luminance and chromaticity, a plurality of different initial duty ratios need only be preset for respective luminance and chromaticity settings. In the embodiment, assume that the duty ratio of a pulsed current for the target light amount value of each color LED element has been set before shipping from a factory so that the LED light source provides a light amount having one chromaticity, and is used as an initial duty ratio.

In the embodiment, to correct the influence of aging on the light amount of each LED element of the light source control unit 180, the storage unit 140 stores an aging correction coefficient for correcting a pulsed current to be supplied to each color LED element of the LED light source. The aging correction coefficient represents, with respect to a reference ambient temperature, the ratio between the pulsed current defined by the initial duty ratio preset before shipping from a factory and the pulsed current supplied to each color LED element when light from the LED light source converges to the target light amount. That is, by multiplying the initial duty ratio by the aging correction coefficient, it is possible to obtain the duty ratio of the pulsed current supplied to each LED element when light from the aging LED element converges to the target light amount at the reference ambient temperature.

Figure 4:
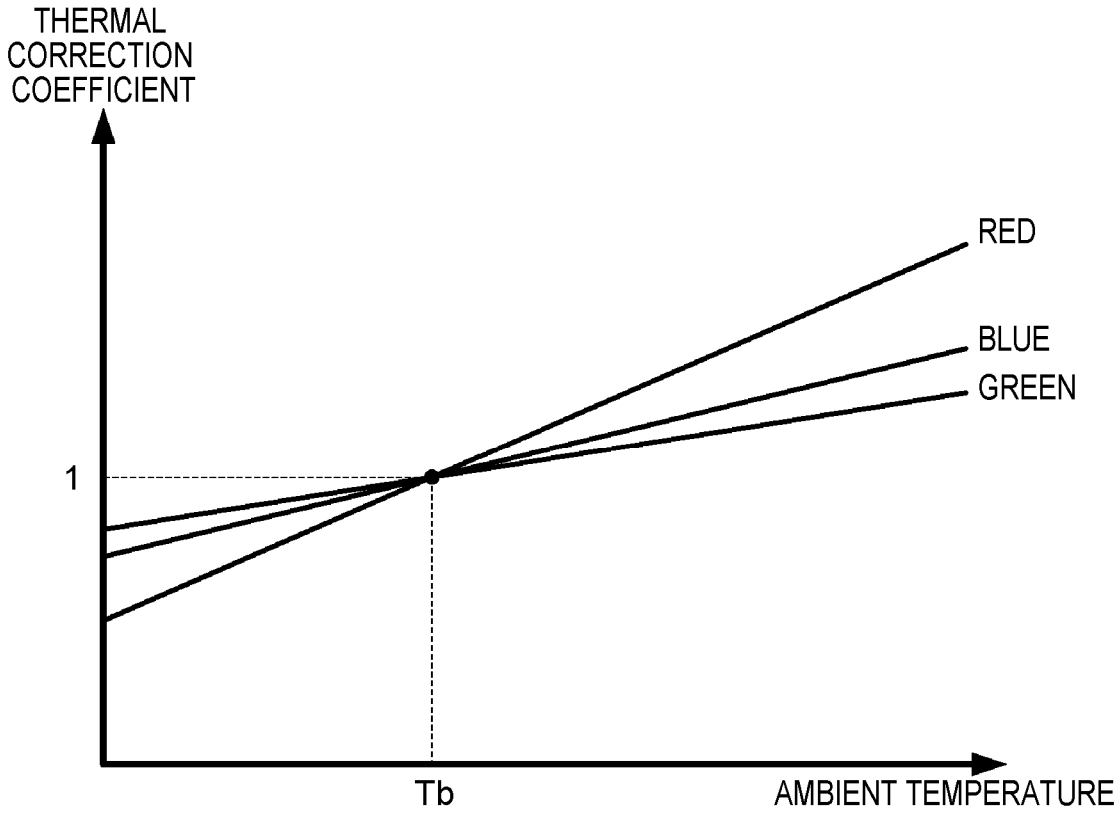
FIG. 4 is a graph showing the relationship between a thermal correction coefficient and the ambient temperature of an LED element according to the embodiment of the present invention.

In the embodiment, a temperature detection unit 160 (to be described later) detects the ambient temperature of each LED element of the light source control unit 180, and the storage unit 140 also stores a table for calculating a thermal correction coefficient for correcting the influence of the ambient temperature on the light amount. The thermal correction coefficient is a correction coefficient for a current value necessary for controlling, to reach the target light amount value, the light amount which can be changed depending on the ambient temperature of each LED element, and is represented as a ratio with respect to a pulsed current supplied to each color LED element at the reference ambient temperature. In the embodiment, with reference to the ambient temperature Tb (reference ambient temperature) of an LED element when an initial duty ratio is defined, the thermal correction coefficient is represented as the ratio between a pulsed current for converging to the target light amount value at a predetermined temperature and a pulsed current defined by the initial duty ratio. More specifically, FIG. 4 shows the relationship between the ambient temperature and the thermal correction coefficient, and the control unit 170 uses a table showing the relationship to determine the thermal correction coefficient for the present ambient temperature of each LED element. As shown in FIG. 4, as the ambient temperature of each LED element becomes higher than the reference ambient temperature, the amount of light radiated by the element becomes small, and therefore, a current value becomes large by controlling to compensate for the decrease in light amount.

In the embodiment, a pulsed current defined by multiplying the initial duty ratio by the above-described aging correction coefficient and thermal correction coefficient is supplied, as an initial current value, to each color LED element upon power-on. That is, this can shorten a time required for light from each LED element to converge to the target light amount value as compared with a case in which the pulsed current defined by the initial duty ratio is supplied as an initial current.

Although the embodiment will be described assuming that processing is implemented in each block which is included as hardware in the liquid crystal monitor 100, the present invention is not limited to this. The processing in each block may be implemented by a program which executes processing similar to that in each block.

An image input unit 110 is, for example, an interface having an input terminal complying with the HDMI (High-Definition Multimedia Interface®) standard, the DVI (Digital Visual Interface) standard, the DisplayPort® standard, or the like. The image input unit 110 transmits, to an image processing unit 120, an image signal input from a PC, a video player, or the like connected through the image input terminal of the image input unit 110.

The image processing unit 120 applies, to the input image signal, correction processing such as luminance correction or gamma correction which has been determined in advance according to the display characteristics and the like of a display unit 130, and outputs the thus obtained corrected image signal to the display unit 130. The display unit 130 is, for example, a liquid crystal panel, which forms an image corresponding to the image signal on its panel by controlling the polarization of a liquid crystal corresponding to each pixel according to the input image signal. The image formed on the panel can be presented in a user visible state when light emitted by the LED light source controlled by the light source control unit 180 (to be described later) enters the rear surface of the panel.

A light amount detection unit 150 is a sensor for detecting the light amount of the LED light source of the light source control unit 180. The light amount detection unit 150 includes, for example, a color sensor and an A/D converter. The unit 150 detects the light amounts of red, green, and blue components, and converts the detected values into digital values to output them to the control unit 170.

The temperature detection unit 160 is a sensor for detecting the ambient temperature of each LED element of the light source control unit 180. More specifically, the temperature detection unit 160 includes, for example, a temperature sensor and an A/D converter. The unit 160 converts, into a digital value, a detected signal obtained by measuring the ambient temperature of each LED element, and outputs it to the control unit 170.

The light source control unit 180 is a block including an LED light source which has red, green, and blue LED elements, and controls the light amount of the LED light source under control of the control unit 170. The detailed arrangement of the light source control unit 180 will be described below.

(Internal Arrangement of Light Source Control Unit 180)

Figure 2:
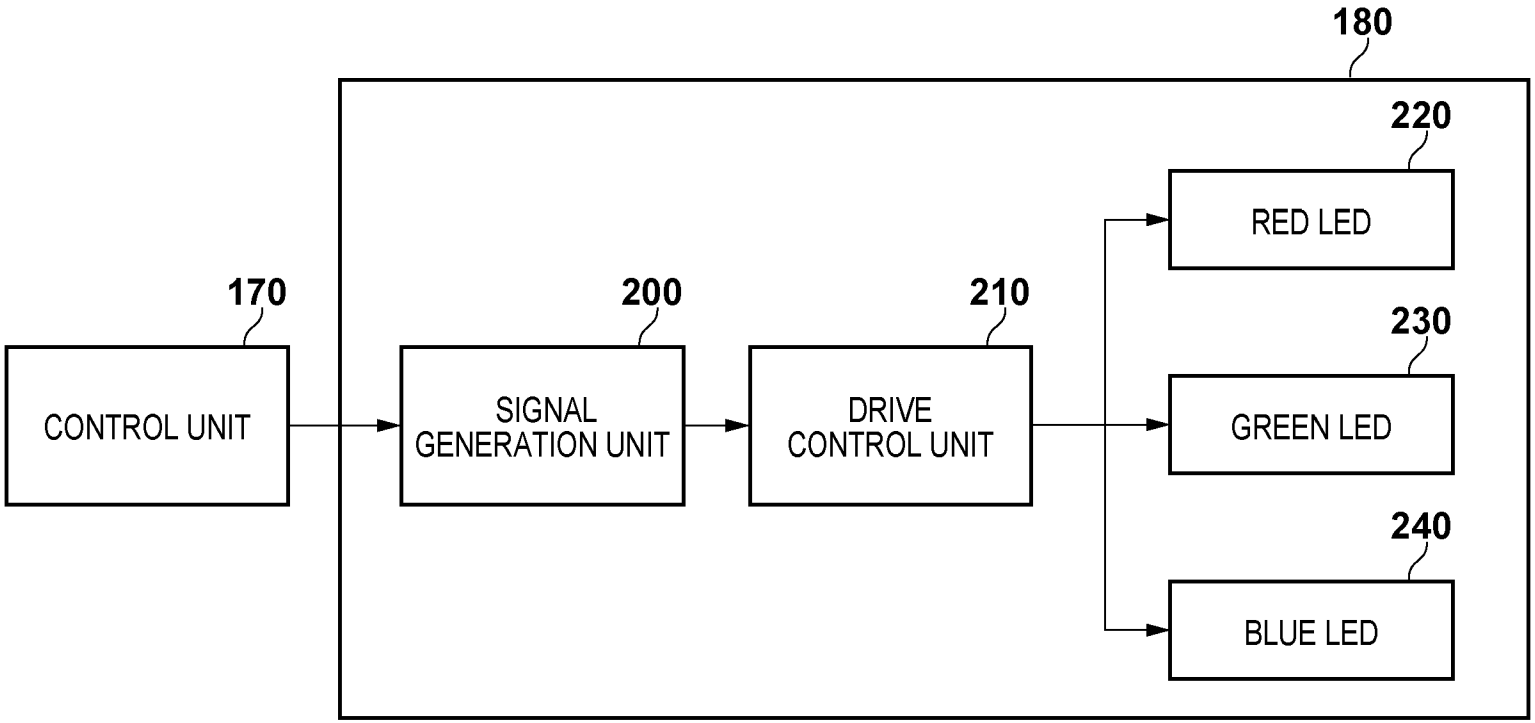
FIG. 2 is a block diagram showing the arrangement of a light source control unit according to the embodiment of the present invention.

FIG. 2 is a block diagram showing the internal arrangement of the light source control unit 180. The light source control unit 180 receives the initial duty ratio of the pulsed current supplied to each color LED element, which has been read out from the storage unit 140. The light source control unit 180 also receives the following parameters depending on the current control status of the LED element:

- a thermal correction coefficient for correction for the ambient temperature of the LED element;
- an aging correction coefficient for correction for aging of the LED element; and
- a control value for a pulsed current, which has been calculated by feedback control executed by the control unit 170 for converging to the target light amount value.

Assume in the embodiment that to indicate a pulsed current to be supplied to each color LED element at a next timing, the control value represents a ratio with respect to the pulsed current defined by the initial duty ratio of each color LED element. The present invention, however, is not limited to this. That is, in feedback control for a light amount, the control value output for a current value to be supplied to each color LED element for converging to the target light amount value is not limited to a ratio with respect to the current value upon power-on, and may be information such as an increment or a ratio with respect to an immediately preceding current value.

A signal generation unit 200 is a block for generating a pulse signal to generate a pulsed current to be supplied to a red LED 220, green LED 230, or blue LED 240 (to be described later). According to the situation, the signal generation unit 200 multiplies the input initial duty ratio of the pulsed current to be supplied to each color LED element by at least one of the above-described thermal correction coefficient, aging correction coefficient, and control value. With this operation, the unit 200 calculates the duty ratio of an appropriate pulse current to be supplied to each LED element, and generates, based on the calculated duty ratio, a pulse signal for causing an drive control unit 210 to output the pulsed current to each LED element.

The drive control unit 210 is a block for controlling light emission of each color LED element by supplying the pulsed current which has been generated based on the pulse signal, input from the signal generation unit 200, for each color LED element. Note that in the embodiment, the following description is given assuming that light emission of each color LED element is controlled using PWM (Pulse Width Modulation) drive for controlling the pulse width as the duty ratio of the pulsed current. The present invention, however, is not limited to this. That is, the present invention is not limited to PWM drive, and a current value to be supplied to each color LED element may be controlled using PAM (Pulse Amplitude Modulation) drive for controlling the amplitude of the pulsed current.

(Aging Correction Coefficient Calculation Processing)

Figure 3:
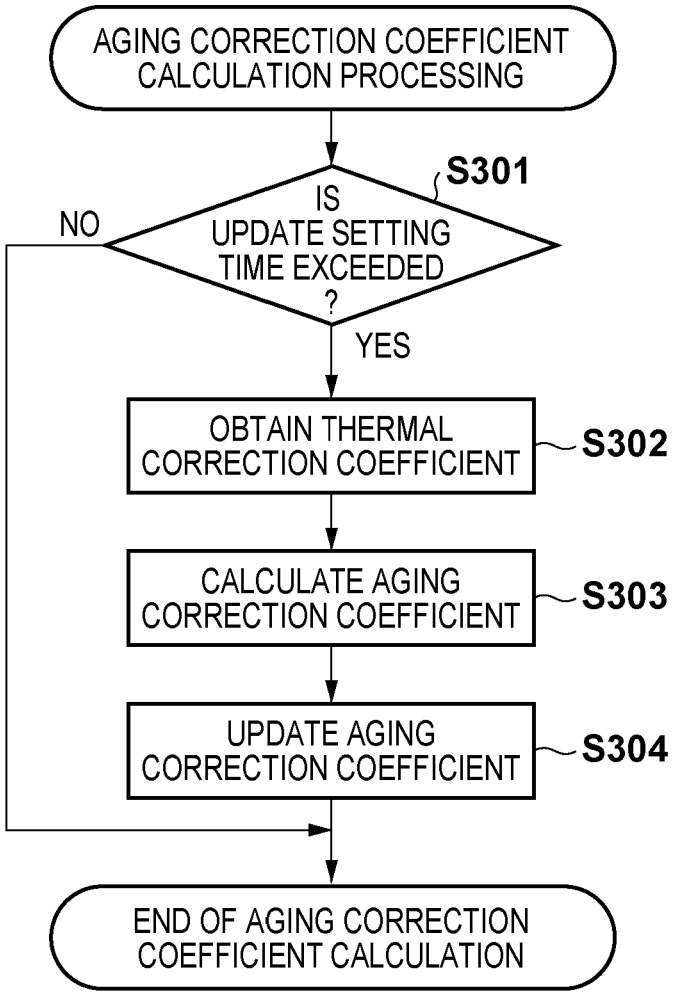
FIG. 3 is a flowchart illustrating aging correction coefficient calculation processing according to the embodiment of the present invention.

Aging correction coefficient calculation processing by the liquid crystal monitor 100 having such an arrangement according to the embodiment will be described in detail with reference to a flowchart shown in FIG. 3. A processing corresponding to the flowchart can be implemented when, for example, the control unit 170 reads out a corresponding processing program stored in the storage unit 140, maps the program on the RAM (not shown), and executes the program. Note that the aging correction coefficient calculation processing starts when light from each LED element of the light source control unit 180 converges to a target light amount value, and is repeatedly executed.

In step S301, the control unit 170 determines whether an accumulated time of lighting of each LED element of the light source control unit 180 exceeds an update setting time set for updating the aging correction coefficient. More specifically, the control unit 170 reads out, from the storage unit 140, information about the accumulated time of lighting of each LED element and information about the update setting time set for updating the aging correction coefficient, and determines whether the accumulated time of lighting exceeds the update setting time. If the control unit 170 determines that the accumulated time of lighting exceeds the update setting time, the process advances to step S302; otherwise, the aging correction coefficient calculation processing ends.

Note that the accumulated time of lighting is counted and updated by an internal timer (not shown) while the liquid crystal monitor 100 is ON. The update setting time is information which is set based on the aging degradation characteristics of the LED element, and a next update setting time is set every time the information is updated. For example, the update setting time may be periodically set to have a given time interval. Furthermore, the update setting time may be determined to have a small interval when the accumulated time of lighting is short and a decrease in light amount with aging is therefore large during the set period, and to have a large interval when the accumulated time of lighting is long and a decrease in light amount is therefore small during the set period.

In step S302, for the present value of the ambient temperature of the LED element, which has been input from the temperature detection unit 160, the control unit 170 obtains the thermal correction coefficient of each color LED element for correcting the influence of the ambient temperature on the light amount with respect to the reference ambient temperature when the initial duty ratio is set. The thermal correction coefficient of each color LED element is obtained from the table which is stored in the storage unit 140 as described above and shows the relationship between the ambient temperature and the thermal correction coefficient. Assume that it is determined in step S301 that the accumulated time of lighting exceeds the update setting time. In this case, if the ambient temperature of the LED element is unstable immediately after the liquid crystal monitor is turned on, because of a change in temperature in an environment in which the liquid crystal monitor is placed, because of a change in setting value of the liquid crystal monitor by the user, or the like, the process may advance to the processing in step S302 after the ambient temperature of the LED element stabilizes.

In the embodiment, to obtain the aging correction coefficient at the reference ambient temperature when the initial duty ratio was set before shipping from a factory, it is necessary to acquire a current value from which the influence of the ambient temperature has been removed from a current value which was changed to achieve the target light amount value at the present ambient temperature. That is, using information about the current value from which the influence of the ambient temperature has been removed, the control unit 170 can recognize the amount of the change in current value due to aging for the light amount of the LED element to reach the target light amount value. Note that although the thermal correction coefficient is determined using the table in the embodiment, it may be calculated using a function indicating the relationship as shown in FIG. 4.

In step S303, the control unit 170 calculates an aging correction coefficient for each color LED element using the thermal correction coefficient determined in step S302 and a correction coefficient (integrated correction coefficient) for correcting the influences of the present ambient temperature and aging of the LED element on the light amount, which is currently set so that the light amount of the LED element reaches the target light amount value. More specifically, the control unit 170 can calculate an aging correction coefficient by dividing the currently set integrated correction coefficient by the thermal correction coefficient determined in step S302. Using the thus obtained aging correction coefficient, it is possible to calculate, with respect to the reference ambient temperature when the initial duty ratio was set before shipping from a factory, the duty ratio of a pulsed current to be supplied to each color LED element to achieve the target light amount value in the present aging state.

Note that although an aging correction coefficient for each color LED element is calculated by dividing the integrated correction coefficient by the thermal correction coefficient in the embodiment, the processing in this step may be as follows. Specifically, the control unit 170 obtains information about the duty ratio of the pulsed current currently supplied by the light source control unit 180 to each color LED element, and divides the obtained duty ratio by the thermal correction coefficient to remove the influence of the temperature from the information. The thus obtained information about the duty ratio indicates the duty ratio of a pulsed current to be supplied to each color LED element to achieve the target light amount value after aging with respect to the predetermined temperature when the initial duty ratio was set before shipping from a factory. The control unit 170 can obtain an aging correction coefficient by calculating the ratio of the duty ratio of the pulsed current to be supplied to each color LED element after aging to the initial duty ratio for each color LED element stored in the storage unit 140.

In step S304, the control unit 170 stores the aging correction coefficient calculated in step S303 in the storage unit 140, and determines an update setting time set for subsequently updating the aging correction coefficient to store it in the storage unit 140, thereby completing the aging correction coefficient calculation processing. Note that if the storage unit 140 already stores an aging correction coefficient, the aging correction coefficient need only be updated with the newly calculated aging correction coefficient.

According to the aging correction coefficient calculation processing, it is possible to obtain an aging correction coefficient which includes no influence of the ambient temperature of the LED element, and can readily conform to various ambient temperatures.

(Light Amount Control Processing)

Figure 5:
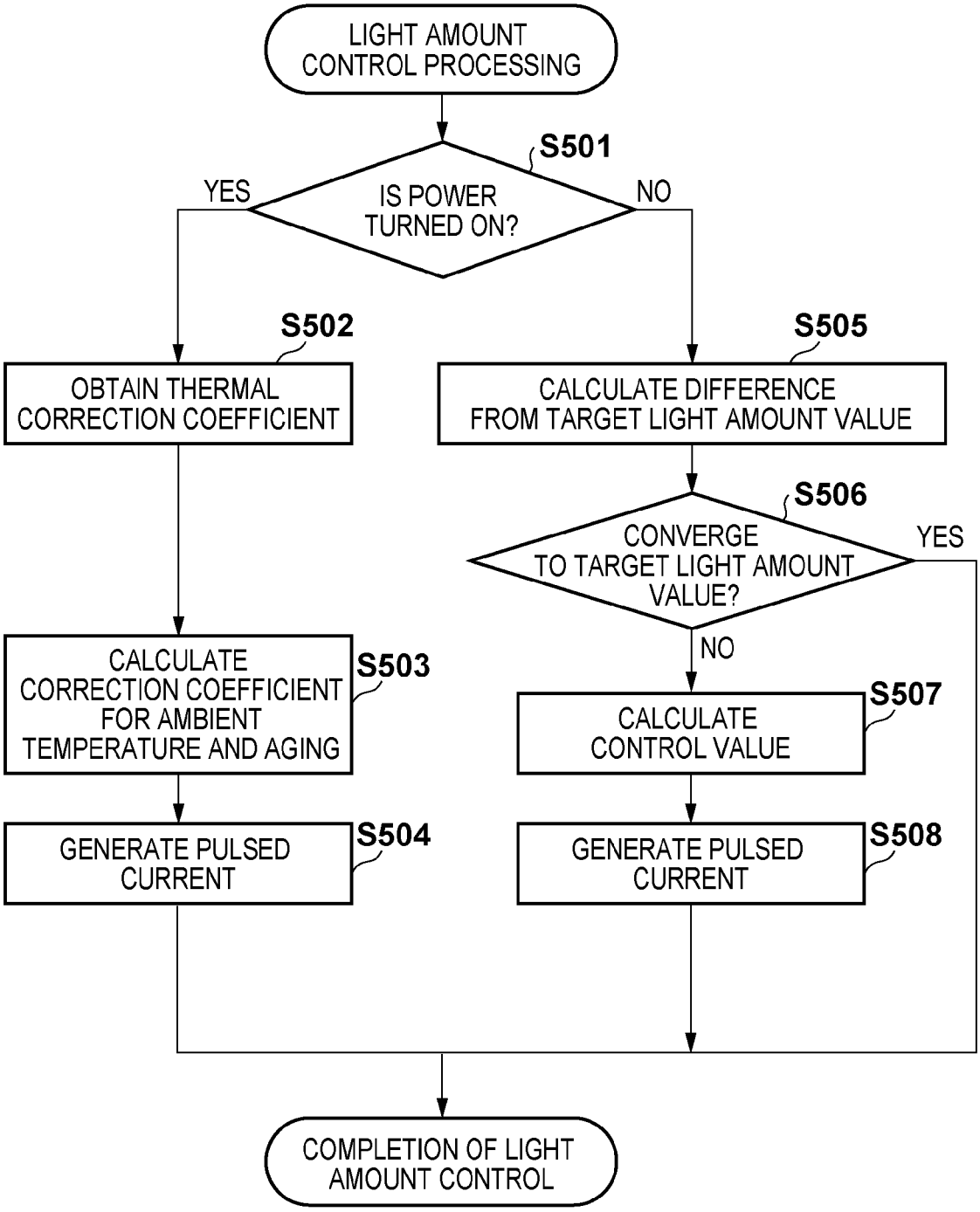
FIG. 5 is a flowchart illustrating light amount control processing according to the embodiment of the present invention.

Light amount control processing by the liquid crystal monitor 100 of the embodiment, which uses the calculated aging correction coefficient, will be described in detail with reference to a flowchart shown in FIG. 5. Processing corresponding to the flowchart can be implemented when the control unit 170 reads out a corresponding processing program stored in the storage unit 140, maps the program on the RAM (not shown), and executes the program. Note that the light amount control processing starts when, for example, the liquid crystal monitor 100 is turned on, and is repeatedly executed while the liquid crystal monitor 100 is ON.

In step S501, the control unit 170 determines whether it is time to supply a pulsed current to each color LED element for the first time after power-on. More specifically, the control unit 170 determines whether the light source control unit 180 has already supplied a pulsed current to each color LED element. If the control unit 170 determines that it is time to supply a pulsed current to each color LED element for the first time after power-on, the process advances to step S502; otherwise, the process advances to step S505.

In step S502, the control unit 170 obtains or calculates a thermal correction coefficient for each color LED element based on the present value of the ambient temperature of the LED element input by the temperature detection unit 160. More specifically, the control unit 170 obtains or calculates a thermal correction coefficient corresponding to the present ambient temperature of the LED element detected by the temperature detection unit 160 from the table which is stored in the storage unit 140 and shows the relationship between the thermal correction coefficient and the ambient temperature of the LED element.

In step S503, the control unit 170 reads out the aging correction coefficient of each color LED element stored in the storage unit 140, and multiplies it by the thermal correction coefficient obtained in step S502, thereby calculating an integrated correction coefficient for correcting the influences of the present ambient temperature and aging of the LED element on the light amount. That is, the aging correction coefficient stored in the storage unit 140 by the above-described aging correction coefficient calculation processing is used to correct the influence of aging on the light amount at the reference ambient temperature Tb when the initial duty ratio was set, and is therefore not suitable for the present ambient temperature. That is, in this step, it is possible to obtain an optimal integrated correction coefficient for the present status of the LED element by including aging correction coefficients for temperature correction at each present ambient temperature of the LED element in those stored in the storage unit 140.

In step S504, the control unit 170 transmits, to the light source control unit 180, the integrated correction coefficient for each color LED element which has been obtained in step S503, and the initial duty ratio read out from the storage unit 140. In the light source control unit 180, the signal generation unit 200 generates a pulse signal based on a duty ratio obtained by multiplying the input integrated correction coefficient by the initial duty ratio. The drive control unit 210 generates a pulsed current for each color LED element according to the pulse signal. At this time, the pulsed current supplied to each color LED element has a duty ratio which is different from the initial duty ratio and has been obtained by considering the present ambient temperature and aging of the LED element. If, for example, the ambient temperature is high and the number of years of use is large, it is possible to shorten a time required to converge to the target light amount value by setting, as an initial current, a pulsed current which is considered to converge to the target light amount and is defined by a duty ratio larger than the initial duty ratio.

The control unit 170 supplies, to each color LED element in the light source control unit 180, the initial current which has been controlled using the integrated correction coefficient obtained by correcting the ambient temperature and aging for each color LED element, and then ends the light amount control processing.

If it is determined in step S501 that a pulsed current has already been supplied to each color LED element, the control unit 170 calculates, in step S505, a difference between the target light amount value stored in the storage unit 140 and the light amount of light output from each color LED element, which has been detected by the light amount detection unit 150. That is, in this step, the control unit 170 obtains a difference, as a reference of the control value of each color LED element, between the target light amount value and the present light amount of each color LED element to calculate the control value.

In step S506, the control unit 170 determines for each color LED element whether the present light amount converges to the target light amount value. More specifically, the control unit 170 determines for each color LED element whether the absolute value of the difference, obtained in step S505, between the present light amount and the target light amount value is not larger than a predetermined threshold indicating a light amount range within which light is determined to converge to the target light amount value.

Note that the threshold for the light amount difference for determining that the light amount converges to the target light amount value is determined based on a light amount detection error for each color LED element, and is set to exceed the range of fluctuation in light amount so as to ignore a variation in light amount due to noise.

If the control unit 170 determines that the present light amounts of all the color LED elements converge to the target light amount value, it controls not to change the duty ratio of the pulsed current currently supplied to each color LED element, and ends the light amount control processing. If the control unit 170 determines that the light amount of at least one of the color LED elements does not converge to the target light amount value, it executes processing in step S507 and subsequent steps for the color LED element, the light amount of which does not converge.

In step S507, for the color LED element, the light amount of which does not converge to the target light amount element, the control unit 170 calculates an integrated correction coefficient (control value) for a pulsed current to be supplied at a next timing. In the embodiment, to execute PWM control, a pulsed current which is generated by the drive control unit 210 and is to be supplied to each LED element is controlled by determining the integrated correction coefficient indicating a ratio with respect to the initial duty ratio. The present invention, however, is not limited to this. The integrated correction coefficient may indicate a ratio with respect to the duty ratio of a pulsed current which has been supplied to the LED element at the immediately preceding timing.

More specifically, the control unit 170 determines the strength of the pulsed current to be supplied at the next timing based on the sign of the difference from the target light amount value calculated in step S505 for the color LED element, the light amount of which does not converge to the target light amount, thereby calculating an integrated correction coefficient. That is, if the light amount of the LED element is smaller than the target light amount value, the integrated correction coefficient is 1 or larger. If the light amount of the LED element is larger than the target light amount value, the integrated correction coefficient is smaller than 1.

Note that in this step, feedback control executed by the control unit 170 to calculate an integrated correction coefficient may be, for example, proportional control using a preset proportionality coefficient. That is, it is possible to obtain a correction coefficient by determining an increase according to the light amount value difference, and calculating the ratio between the initial duty ratio and a duty ratio for supplying a pulsed current for the increase.

In step S508, the control unit 170 transmits, to the light source control unit 180, the integrated correction coefficient obtained in step S507 for the color LED element, the light amount of which does not converge to the target light amount value, and the initial duty ratio read out from the storage unit 140. In the light source control unit 180, the signal generation unit 200 generates a pulse signal based on a duty ratio obtained by multiplying the input integrated correction coefficient by the initial duty ratio. The drive control unit 210 generates a pulsed current for each color LED element according to the pulse signal. Note that for the color LED element for which the light amount has been determined to converge to the target light amount value, the duty ratio of the pulsed current currently supplied to the LED element need only be controlled not to be changed, as described above.

The integrated correction coefficient calculated in step S507 is calculated as a correction coefficient including correction for the ambient temperature and aging of the LED element in the above description but may not include correction for the ambient temperature and aging. In this case, in addition to the correction coefficient, a thermal correction coefficient and aging coefficient for the present ambient temperature of the LED element are input to the light source control unit 180. Then, the duty ratio of a pulsed current to be supplied to the LED element at the next timing is determined using a coefficient obtained by the product of all the coefficients.

As described above, using the aging correction coefficient which has been obtained by the above-described aging correction coefficient calculation processing, does not include the influence of the ambient temperature of the LED element on the light amount, and is used to correct only the influence of aging, it is possible to appropriately set an initial current to be supplied to the LED element upon power-on.

Note that in the embodiment, a light source having three color LED elements, that is, red, green, and blue LED elements has been described assuming that the light amounts of the color components are detected using the color filter of the light amount detection unit 150. The present invention, however, is not limited to this. If, for example, the LED light source of the light source control unit 180 includes a white LED element, the light amount detection unit 150 need not be a sensor having a color filter, and therefore, the amount of light emitted by the white LED element may be detected using a photodiode. In this case, the storage unit 140 need only store an aging correction coefficient, a thermal correction coefficient, an initial duty ratio, and the like for one LED element.

As described above, the light amount control apparatus of this embodiment obtains a coefficient for correcting the influence of aging of an LED element on its light amount in consideration of the influence of the ambient temperature of the LED element. More specifically, the light amount control apparatus stores a first current amount which has been preset so that the light amount of the LED element reaches a target light amount value at a predetermined reference ambient temperature, and a thermal correction coefficient for correcting the first current amount so that the light amount of the element reaches the target light amount value at a temperature different from the reference ambient temperature. Furthermore, when the light amount of the LED element reaches the target light amount value, an aging correction coefficient for correcting the first current amount to correct aging at the reference ambient temperature is calculated from a second current amount supplied to the LED element and a thermal correction coefficient corresponding to the ambient temperature of the LED element, and is then stored.

This enables to appropriately set an initial current to be supplied to the LED element upon power-on, thereby shortening a time required to converge to the target light amount value without depending on the ambient temperature or aging of the LED element.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-106625, filed May 11, 2011, which is hereby incorporated by reference herein in its entirety.

What is claimed is:

1. A light amount control apparatus for controlling a light amount of an LED element by current control, comprising:

a drive control unit configured to supply a current to the LED element;

a light amount detection unit configured to detect the light amount of the LED element;

a temperature detection unit configured to detect an ambient temperature of the LED element;

a storage unit configured to store a first current amount which has been preset so that the light amount of the LED element reaches a target light amount value at a predetermined reference ambient temperature, and a thermal correction coefficient for correcting the first current amount so that the light amount of the LED element reaches the target light amount value at an ambient temperature different from the predetermined reference ambient temperature; and a calculation unit configured to calculate, when the light amount of the LED element detected by said light amount detection unit reaches the target light amount value, from a second current amount supplied to the LED element by said drive control unit and the thermal correction coefficient corresponding to the ambient temperature of the LED element, an aging correction coefficient for correcting the first current amount to correct a change in light amount due to aging of the LED element at the predetermined reference ambient temperature, and to store the calculated aging correction coefficient in said storage unit.

2. The apparatus according to claim 1, wherein the thermal correction coefficient is a ratio of a current amount supplied by said drive control unit so that the light amount of the LED element reaches the target light amount value, at a temperature different from the reference ambient temperature, to the first current amount and said calculation unit calculates the aging correction coefficient as a ratio of a value obtained by dividing the second current amount by the thermal correction coefficient corresponding to the ambient temperature of the LED element when the second current amount is supplied to the LED element, to the first current amount.

3. The apparatus according to claim 1, further comprising a determination unit configured to determine a current amount supplied to the LED element by said drive control unit, wherein when said apparatus is turned on, said determination unit determines, as an initial current amount to be supplied to the LED element, a current amount obtained by multiplying the first current amount by the aging correction coefficient and the thermal correction coefficient at the ambient temperature of the LED element detected by said temperature detection unit.

4. A display apparatus comprising a light amount control apparatus according to claim 1.

5. A display apparatus comprising:

a light amount control apparatus according to claim 1; and a display panel configured to display images.

6. A control method for a light amount control apparatus including a storage unit configured to store a first current amount which has been preset so that a light amount of an LED element reaches a target light amount value at a predetermined reference ambient temperature, and a thermal correction coefficient for correcting the first current amount so that the light amount of the LED element reaches the target light amount value at an ambient temperature different from the predetermined reference ambient temperature, the method comprising:

a drive control step of supplying a current to the LED element;

a light amount detection step of detecting the light amount of the LED element;

a temperature detection step of detecting an ambient temperature of the LED element;

and a calculation step of calculating, when the light amount of the LED element detected in the light amount detection step reaches the target light amount value, from a second current amount supplied to the LED element in the drive control step and the thermal correction coefficient corresponding to the ambient temperature of the LED element, an aging correction coefficient for correcting the first current amount to correct a change in light amount due to aging of the LED element at the predetermined reference ambient temperature, and storing the calculated aging correction coefficient in the storage unit.

7. A light amount control apparatus for controlling a light amount of a light emitting element, comprising:

a drive control unit configured to drive the light emitting element by controlling a driving value of the light emitting element;

a light amount detection unit configured to detect the light amount of the light emitting element;

a temperature detection unit configured to detect an ambient temperature of the light emitting element;

a storage unit configured to store a first driving value which has been preset so that the light amount of the light emitting element reaches a target light amount value at a predetermined reference ambient temperature, and a thermal correction coefficient for correcting a change in the light amount of the light emitting element at an ambient temperature different from the predetermined reference ambient temperature; and a determination unit configured to determine an aging correction coefficient for correcting a change in light amount due to aging of the light emitting element at the predetermined reference ambient temperature based on a driving correction coefficient, which is a coefficient regarding related to the first driving value and determined such that the light amount of the light emitting element reaches the target light amount value on a predetermined condition, and the thermal correction coefficient corresponding to the ambient temperature of the light emitting element on the predetermined condition.

8. The apparatus according to claim 7, wherein the determination unit determines the driving correction coefficient in accordance with the target light amount value and the light amount of the light emitting element detected on the predetermined condition by the light amount detection unit.

9. The apparatus according to claim 7, wherein the thermal correction coefficient is a coefficient determined based on the first driving value and a second driving value by which the drive control unit drives the light emitting element such that the light amount of the light emitting element reaches the target light amount value at the ambient temperature different from the predetermined reference ambient temperature.

10. The apparatus according to claim 7, further comprising a setting unit configured to set a driving value by which the drive control unit drives the light emitting element, wherein when the apparatus is powered on, the setting unit sets an initial driving value of the light emitting element which is determined based on the first driving value, the aging correction coefficient and the thermal correction coefficient corresponding to the ambient temperature detected by the temperature detection unit on a timing corresponding to power-on of the apparatus.

11. The apparatus according to claim 7, wherein the driving value is a duty ratio of a pulsed current by which the drive control unit drives the light emitting element.

12. The apparatus according to claim 7, wherein the predetermined condition is a predetermined timing after power-on of the apparatus.

13. A control method for a light amount control apparatus including a storage unit configured to store a first driving value which has been preset so that a light amount of a light emitting element reaches a target light amount value at a predetermined reference ambient temperature, and a thermal correction coefficient for correcting a change in the light amount of the light emitting element at an ambient temperature different from the predetermined reference ambient temperature, the method comprising:

a drive control step of driving the light emitting element by controlling a driving value of the light emitting element;

a light amount detection step of detecting the light amount of the light emitting element;

a temperature detection step of detecting an ambient temperature of the light emitting element; and a determination step of determining an aging correction coefficient for correcting a change in light amount due to aging of the light emitting element at the predetermined reference ambient temperature based on a driving correction coefficient, which is a coefficient regarding related to the first driving value and determined such that the light amount of the light emitting element reaches the target light amount value on a predetermined condition, and the thermal correction coefficient corresponding to the ambient temperature of the light emitting element on the predetermined condition.

14. The control method according to claim 13, wherein the determination step determines the driving correction coefficient in accordance with the target light amount value and the light amount of the light emitting element detected on the predetermined condition in the light amount detection step.

15. The control method according to claim 13, wherein the thermal correction coefficient is a coefficient determined based on the first driving value and a second driving value by which the drive control step drives the light emitting element such that the light amount of the light emitting element reaches the target light amount value at the ambient temperature different from the predetermined reference ambient temperature.

16. The control method according to claim 13, further comprising a setting step of setting a driving value by which the drive control step drives the light emitting element, wherein when the apparatus is powered on, the setting step sets an initial driving value of the light emitting element which is determined based on the first driving value, the aging correction coefficient and the thermal correction coefficient corresponding to the ambient temperature detected in the temperature detection step on a timing corresponding to power-on of the apparatus.

17. The control method according to claim 13, wherein the driving value is a duty ratio of a pulsed current by which the drive control step drives the light emitting element.

18. The control method according to claim 13, wherein the predetermined condition is a predetermined timing after power-on of the apparatus.

* * * * *